US006216524B1

(12) United States Patent
Weschler

(10) Patent No.: US 6,216,524 B1
(45) Date of Patent: Apr. 17, 2001

(54) DUAL CLAMPING ADAPTER AND VEHICLE REPAIRING DEVICE

(75) Inventor: Bradley R. Weschler, Huntington Station, NY (US)

(73) Assignee: Quick Stick, Inc., Hauppauge, NY (US)

( * ) Notice: Subject to any disclaimer, the term of this patent is extended or adjusted under 35 U.S.C. 154(b) by 0 days.

(21) Appl. No.: 09/451,380

(22) Filed: Nov. 30, 1999

(51) Int. Cl.[7] ..... B21J 13/08
(52) U.S. Cl. ..... 72/457; 72/305; 72/705
(58) Field of Search ..... 72/705, 457, 295, 72/305

(56) References Cited

U.S. PATENT DOCUMENTS

| | | | | |
|---|---|---|---|---|
| 3,141,493 | | 7/1964 | Textor, Sr. . | |
| 3,292,410 | | 12/1966 | Baldassano . | |
| 3,340,720 | | 9/1967 | Chartier . | |
| 3,691,817 | | 9/1972 | Friend et al. . | |
| 3,921,433 | | 11/1975 | Whitney . | |
| 5,014,538 | * | 5/1991 | Eltvik | 72/705 |
| 5,016,465 | | 5/1991 | Papesh . | |
| 5,031,438 | | 7/1991 | Flannery . | |
| 5,054,307 | * | 10/1991 | Wisner | 72/705 |
| 5,186,039 | * | 2/1993 | Celette | 72/705 |

FOREIGN PATENT DOCUMENTS

| | | |
|---|---|---|
| 2606806 | 8/1977 | (DE) . |
| 2739528 | 3/1979 | (DE) . |
| 0269538 | 6/1988 | (EP) . |

OTHER PUBLICATIONS

International Search Report—Int. Application No. PCT/US96/12778 Clamping Adapter (for Basic Holding System) Owners Manuel 1994.
One Page of Brochure Identifying Honda ('90) Clamp One Page Brochure Identifying Honda Adapters.
One Page Brochure Identifying Honda Acura Combination Clamp System.

* cited by examiner

*Primary Examiner*—Ed Tolan
(74) *Attorney, Agent, or Firm*—Galgano & Burke

(57) ABSTRACT

A dual clamping adapter for securing a vehicle body undercarriage having both horizontal pinchwelds and vertical jack tabs to a vehicle repairing device includes a generally L-shaped clamp bracket having a generally upright upper leg and a generally horizontal lower leg, a first pair of clamps for releasably clamping a horizontal pinchweld of a vehicle body undercarriage and a second pair of clamps for releasing clamping a vertical jack tab of a vehicle body undercarriage. The first and second clamping plates are adjustably mounted on the upper and lower leg of the clamp bracket, respectively and the clamp bracket is height adjustable. A vehicle repairing device utilizing the aforementioned dual clamping adapter is also disclosed.

17 Claims, 5 Drawing Sheets

DUAL CLAMPING ADAPTER AND VEHICLE REPAIRING DEVICE

RELATED APPLICATIONS

This is a continuation-in-part application of U.S. patent application Ser. No. 09/369,607 filed on Aug. 6, 1999 which is a continuation-in-part application of Ser. No. 08/888,572 which issued as U.S. Pat. No. 5,910,186 on Jun. 8, 1999, which was a continuation-in-part application of U.S. patent application Ser. No. 08/620,989 which issued as U.S. Pat. No. 5,644,946 on Jul. 8, 1999, which is a continuation-in-part of U.S. patent applications Ser. Nos. 08/401,764 and 08/401,765, both filed Mar. 10, 1995, the subject matter of which are incorporated herein by reference thereto.

The present invention is directed to a dual clamping adapter for vehicle repairing devices and, more particularly, to vehicle repairing devices which comprise a generally V-shaped base which is readily attachable to three separate, paired horizontal pinchweld and vertical tab locations on a unibody.

BACKGROUND OF THE INVENTION

Vehicles damaged in an accident usually require expensive repairs including careful and accurate straightening and correction of the deformation. Devices for repairing damaged vehicles typically include a number of beams attached to each other at 90 degrees. In addition, they typically require the vehicle to be jacked up so that the device can be positioned under the vehicle, wherein the device is attached to the vehicle at typically four locations. Such devices are costly, require extensive time to set up, and require highly skilled technicians to operate.

It is therefore desirable to provide vehicle repairing devices which are low cost and compact, readily set up and operated, and which provide effective repair of damaged unibodies.

This object is achieved with the vehicle repairing device disclosed in my prior U.S. Pat. No. 5,910,186. The device comprises a generally V-shaped base comprising a first substantially horizontal elongated member and a second substantially horizontal elongated member attachable to each other at an angle of less than 90 degrees. A pair of clamps are attached to the first member to attach the first member to a vehicle, preferably at two different pinchweld locations. A separate clamp attaches the second member to the vehicle, preferably at another location which is different from the two pinchweld locations to which the first member is attached.

Generally for most cars, "single" pairs of clamps are needed for the three clamping locations. However, for certain vehicles, such as Honda® motor vehicles, it is necessary to secure the vehicle body, which is of a so-called "unibody frame construction", with "dual" clamps at each of the clamp positions. Specifically, the clamp must be affixed to both the vehicle's horizontal pinchweld and the vertical jack tab at each clamp position. Otherwise, attempting to repair the vehicle with a pulling device with only either the horizontal pinchwelds or vertical jack tabs clamped could result in distortion and/or deformation of the vehicle unibody.

Clamping adapters have been proposed to provide these dual clamping functions but they generally are high in cost, complicated, difficult to use and/or not easily or universally adaptable. For example, one conventional clamping adapter requires the use of a multiplicity of shims to adjust the height of the clamps which incurs additional set-up time.

Accordingly, it is an object of the present invention to provide a dual clamping adapter for vehicle repairing devices which is relatively simple in construction and economical to fabricate, which allows ready set-up and operation and which is readily adaptable to variously configured and dimensioned vehicle framed bodies.

Certain of the foregoing and related objects are readily attained in a dual clamping adapter for securing a vehicle body undercarriage having both horizontal pinchwelds and vertical jack tabs to a vehicle repairing device comprising a generally L-shaped clamp bracket having a generally upright upper leg and a generally horizontal lower leg, first means for releasably clamping a horizontal pinchweld of a vehicle body undercarriage, second means for releasing clamping a vertical jack tab of a vehicle body undercarriage, means for adjustably mounting said first means for releasably clamping on said upper leg of said clamp bracket and said second means for releasably clamping on said lower leg of said clamp bracket, and means for adjusting the height of said clamp bracket.

Preferably, the first and second means for releasably clamping comprises a pair of clamping plates. Desirably, the means for adjustably mounting comprises at least one elongated slot formed in said upper leg and at least one elongated slot formed in said horizontal leg. Advantageously, the means for adjusting the height of said clamp comprises a generally vertically-disposed threaded rod having a top end releasably secured to said lower leg of said clamp bracket. Most advantageously, the rod is supported in a cylindrical tube for vertically displaceably movement and said means for adjusting the height includes means for locking said rod at a fixed height relative to said tube. Most desirably, the lower leg of the bracket is Y-shaped. The lower leg of the bracket preferably has a downwardly depending leg and the rod has means for releasably clamping said downwardly depending leg.

Certain of the foregoing and related objects are also attained in a device for straightening damaged vehicle bodies with an undercarriage having both horizontal pinchweld and vertical jack tabs comprising a first elongated member which is selectively positionable under the undercarriage of a damaged vehicle body, said first elongated member comprising a first end and a second end, a second elongated member selectively attachable to said first elongated member at an angle of less than 90 degrees, means for applying a pulling force selectively connectable to at least one of said elongated members and means for attaching said force applying means to a damaged vehicle, and two clamps slidably mounted on said first elongated member for attaching said first elongated member to said damaged vehicle body, and a clamp slidably mounted on said second elongated member for attaching said second elongated member to said damaged vehicle body, said clamps each being of the type described above.

These and other embodiments of the present invention are described below with reference to the figures.

DETAILED DESCRIPTION OF THE PREFERRED EMBODIMENT

Figure 1:
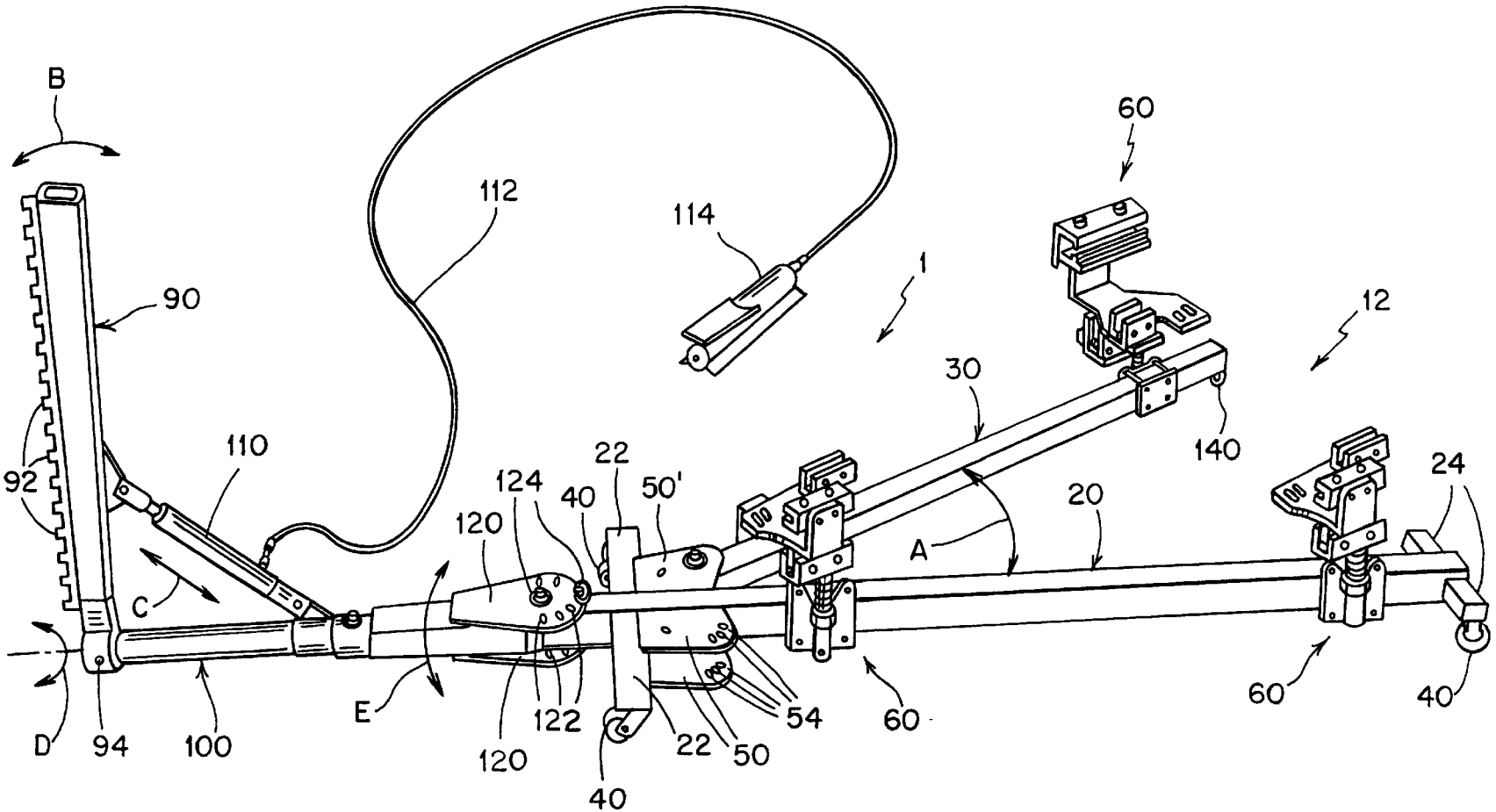
FIG. 1 is a perspective view of a vehicle repairing device and the dual clamping adapter of the present invention.

Turning now to the drawings, therein illustrated in FIG. 1 is a vehicle repairing device 1 embodying the present invention for repairing a damaged vehicle body (typically a unibody). Vehicle repairing device 1 generally comprises a generally V-shaped base 12 comprising a first substantially horizontal elongated member or main beam 20, and a second substantially horizontal elongated member or side arm 30, which are attachable to each other so as to define an angle A therebetween (double-headed arrow A) which is less than 90 degrees.

Main beam 20 and side arm 30 are preferably hollow beams and have a substantially uniform cross-section, e.g., beams having a hollow square or rectangular cross-section. Side supports 22 and 24 extend outwardly from opposite sides of main beam 20 and are provided with ground supporting wheels 40. Likewise, side arm 30 is provided with ground supporting wheels 40 (only one of which is shown).

Main beam 20, which preferably attaches to two locations on a vehicle, is sized larger relative to side arm 30 since side arm 30 attaches preferably to one location on the vehicle.

Main beam 20 and side arm 30 are preferably pivotally attachable to each other so as to readily allow angle A therebetween to be varied from about 20 degrees to about 70 degrees, and desirably, from about 30 degrees to about 60 degrees. A pair of spaced-apart upper and lower pivot plates 50 and 50' are mounted to main beam 20, and side supports 22 so that portions of plate 50 and 50' extend outward from main beam 20.

Pivot plates 50 and 50' are provided with a downwardly depending pin 52 and a plurality of vertically aligned through holes 54 spaced-apart along a curve, at least one of which is alignable with a threaded hole of side arm 30 (not shown) to allow pin 52 to be inserted in both aligned holes, thus locking side arm 30 in a fixed angular position relative to main beam 20; further details of the construction of the vehicle repairing device is disclosed in U.S. Pat. No. 5,910,186.

Clamps 60 according to the present invention are slidably mountable on main beam 20 and side arm 30, respectively, and attach main beam 20 and side arm 30 to a vehicle undercarriage 13 at various locations, such as to a unibody at various horizontal pinchweld 15 and vertical jack tab 17 locations. As seen best in FIG. 2, clamps 60 each comprise a first plate 62 and a second plate 64 which are disposed on opposite sides of main beam 20 (or side arm 30) and are connected together by four bolts 66. By tightening bolts 66, plates 62 and 64 are securely mounted and fixed in position on main beam 20. Attached to plate 62 is an upright cylindrical tube 68 which receives a threaded rod 70 which is pivotally or rotatably retained therein.

Figure 3:
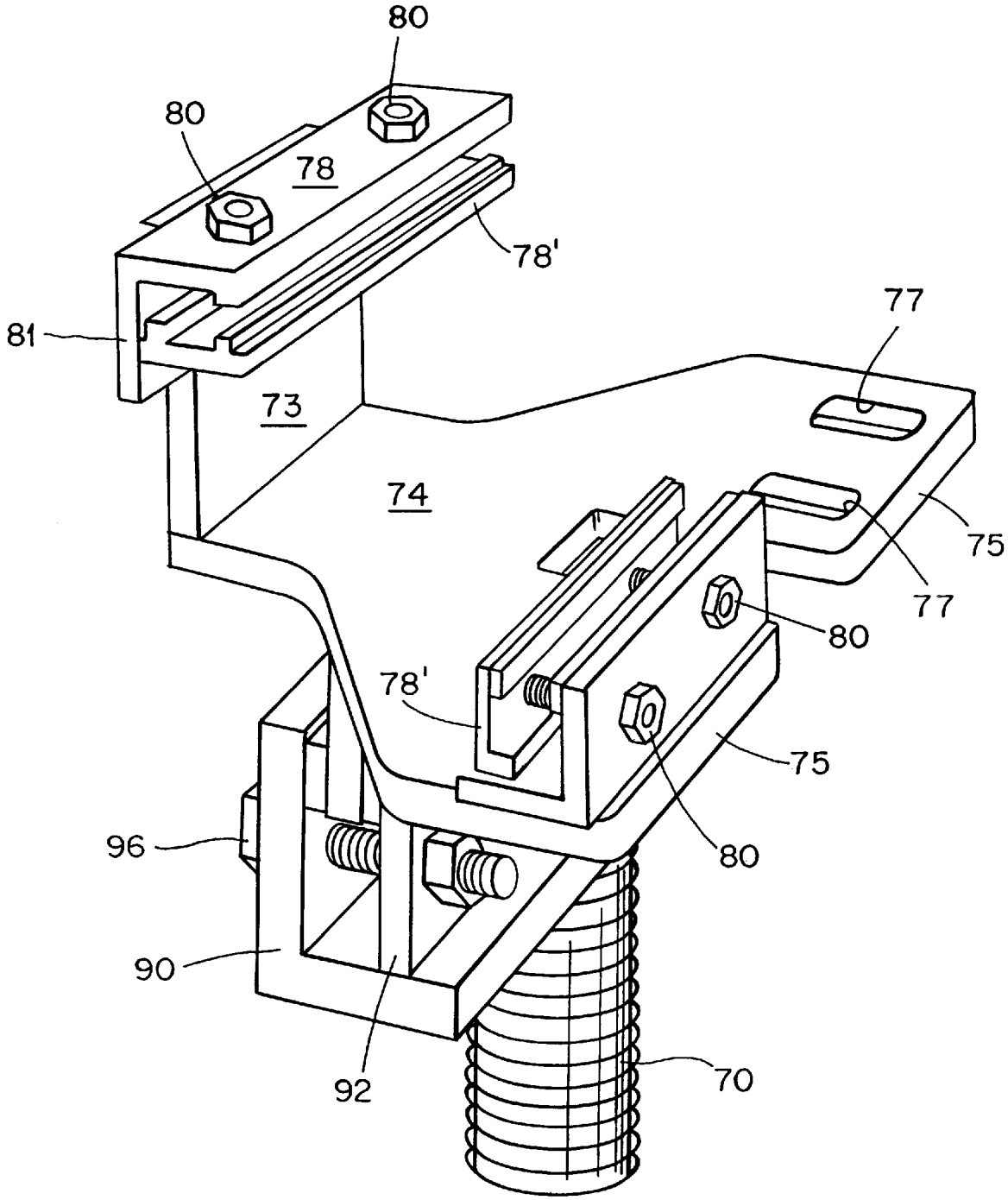
FIG. 3 is an enlarged perspective view of the dual clamping adapter.
Figure 4:
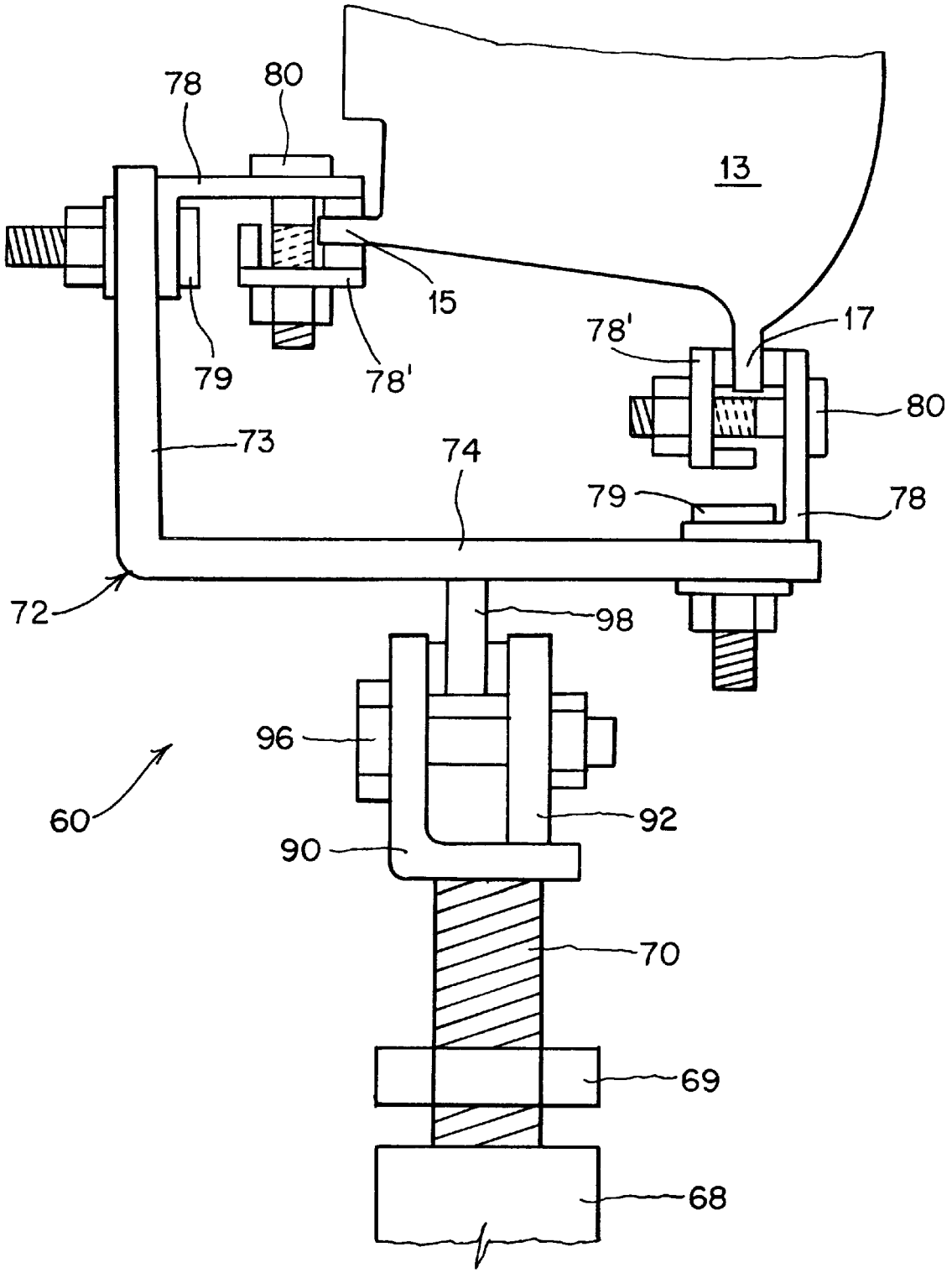
FIG. 4 is an enlarged side elevational view of the clamping adapter in clamping position affixed to the undercarriage of a vehicle body.

As seen best in FIGS. 3 and 4 attached to the upper end of threaded rod 70 is an L-shaped clamping plate 90 to which a mating, spring loaded clamping plated 92 is attached via a pair of bolts 96. A generally L-shaped dual clamp adapter or support member or bracket 72 is releasably attached to clamping plates 90, 92 via its downwards depending leg 98. Bracket 72 has a generally upright rectangular upper support leg 73 joined to a generally horizontally disposed, Y-shaped lower support leg 74 having a base section to which the upper support leg 73 is secured and a pair of arms 75. As best seen in FIG. 3, both upper leg 73 and arms 75 are each provided with a pair of elongated slots 76, 77, respectively, for the purpose of releasably and adjustably supporting a pair of clamping plates 78, 78' for clamping to a horizontal pinchweld 15, or vertical jack tab 17 or other supporting portion of the frame body or unibody undercarriage 13 of a vehicle.

Figure 2:
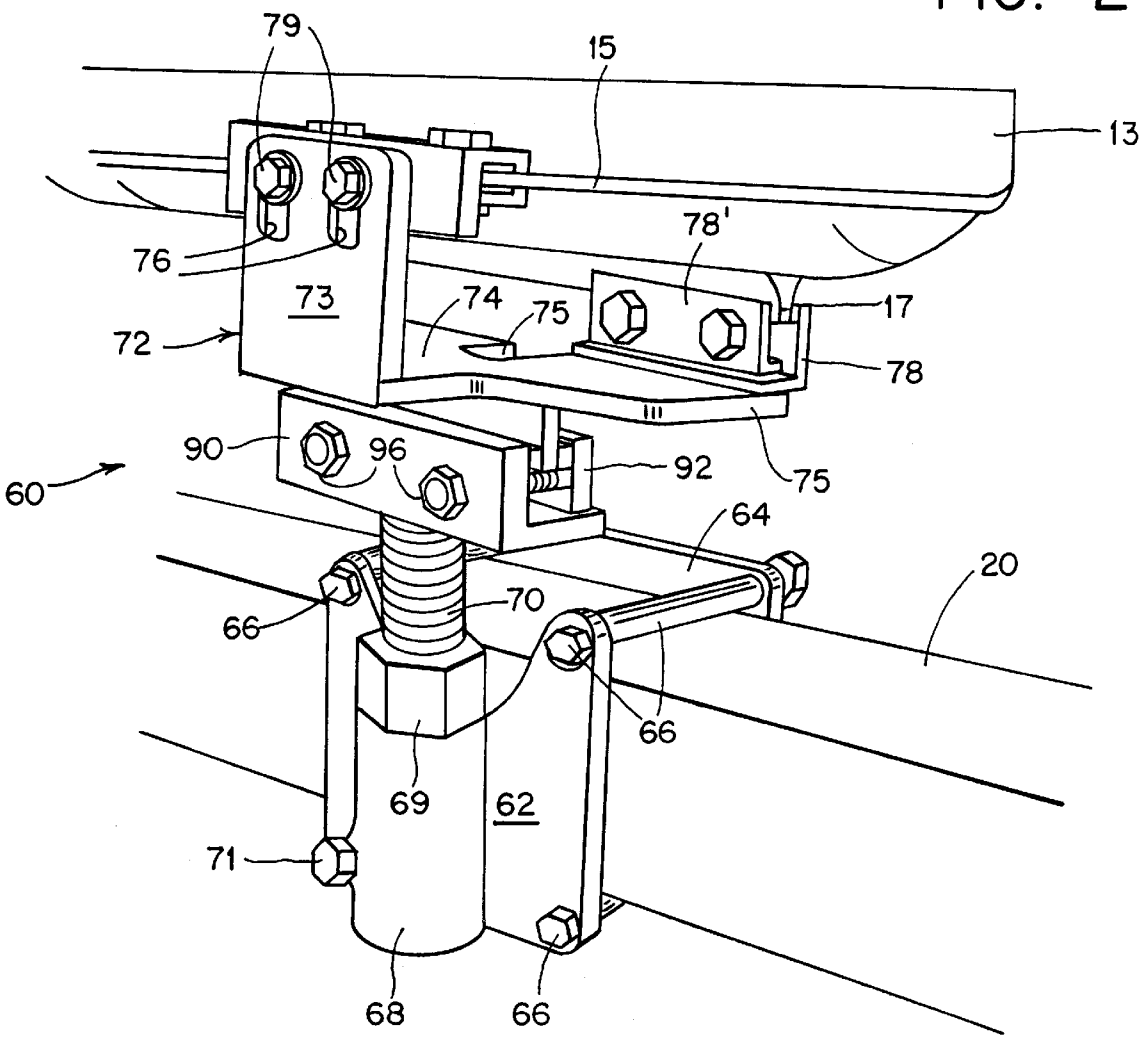
FIG. 2 is an enlarged perspective view of the clamping adapter in use affixed to the undercarriage of a vehicle body.

As shown best in FIG. 4, clamping plates 78 are generally L-shaped and each has a support leg 81 with a pair of spaced-apart, threaded holes (not shown) by which the clamping plates 78 may be mounted on the upper and lower legs 73, 74 of the support member 72 via a pair of threaded bolts 79. Clamping plates 78' are likewise provided with a pair of spaced-apart holes (not shown) by which each pair of clamping plates 78, 78' are clamped together via spring loaded bolts 80. The pair of clamping plates 78, 78' mounted on one of the arms 75 serve to clamp the downwardly depending jack tab 17 of the vehicle undercarriage 13. Similarly, the pair of clamps 78, 78' mounted on upper leg 73 serve to clamp the horizontally extending pinchweld 15 of the vehicle undercarriage 13. As seen in FIGS. 2 and 4, a nut 69 is threadably received on threaded rod 70 to allow height adjustment of clamping bracket 72 relative to main beam 20 and/or side arm 30. In addition, a threaded bolt 71 extends through the wall of cylindrical tube 68 to bear against threaded rod 70 and lock the same in place at a desired height. Clamp 60 which is slidably mountable on side arm 30 is essentially the same as that described above with reference to clamp 60 or main arm 20 except its position is reversed.

Figure 5:
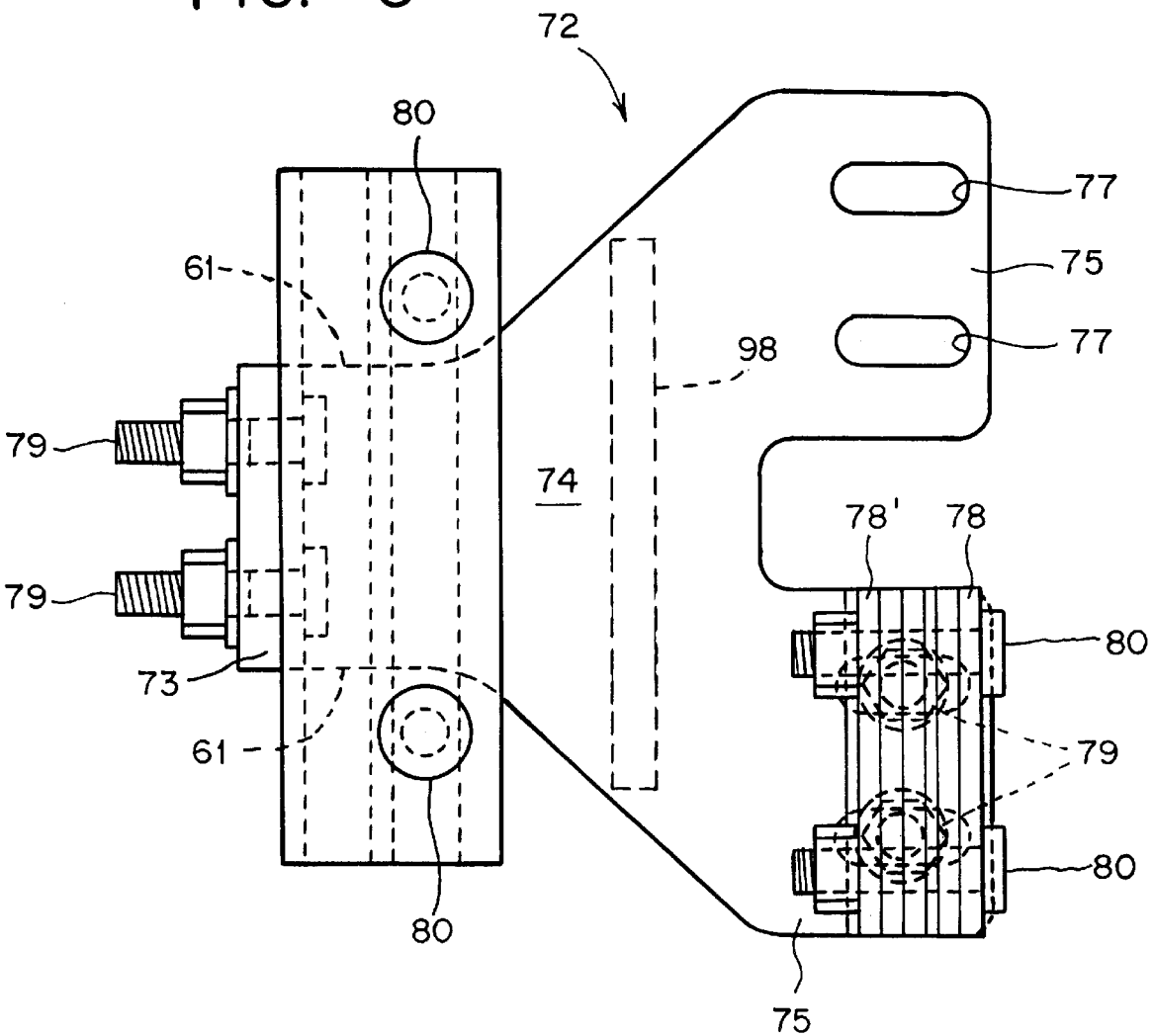
FIG. 5 is a top plan view of the clamping adapter.

As seen in FIG. 5, the lower support leg 74 preferably has a Y-shape, with its two arms 75 tapering to a narrow neck section 61 which has a width equal to the upstanding leg 73. As a result of this narrow neck or Y-shaped configuration, easy and ready access is made available to threaded bolts 80 of the clamping plates 78, 78' for clamping to the horizontal pinchweld 15. This enables the technician to use power tools such as an impact wrench to reach and tighten and/or loosen the bolts 80 in an easy and facile manner.

As can be appreciated from the foregoing, clamps 60 are adaptable to variously dimensioned dual clamping locations. Clamps 60 are movable along beam 20 and sidearm 30 to enable the clamps 60 to be positioned at the appropriate clamping positions beneath the vehicle undercarriage at which points the bolts 66 can be tightened to fix the position of the clamps 60.

The height of rod 70 can easily be adjusted via nut 69 to either raise or lower the L-shaped support member or bracket 72 to position it closely to the vehicle undercarriage 13. The vertical position of the clamping plates 78, 78' on upper leg 73 can also be raised or lowered via slots 76 (FIG. 2) to align the clamping plates 78, 78' with the horizontally-extending pinchweld 15 of the vehicle unibody 13. Similarly, the position of the clamping plates 78, 78' on the lower leg 74 can be horizontally or transversely adjusted via slots 77 (FIG.3) either toward or away from the ends of arms 75 to effect alignment thereof with the vertical jack tabs 17 of the vehicle unibody 13. The clamping plates 78, 78' can be mounted on either arm 75 depending on the location of the vertical jack tab 17 of the vehicle unibody; typically one arm 75 is used for the vertical jack tab 17 adjacent the front wheel of the vehicle and the other arm 75 is used for the vertical jack tab 17 adjacent the rear wheel of the vehicle. In addition, it should also be noted that clamp 60 is universally adaptable for use on either side of the vehicle i.e., paired right and left handed clamps are not needed.

Once clamping of the horizontal pinchwelds 15 and vertical jack tabs 17 is effected at the three clamping positions (two on one side of the vehicle and the third on the opposite side of the vehicle), the vehicle is ready to be pulled. It should be noted that, although the desired dual points of attachment are the pinchweld 15 and jack tab 17, other functionally equivalent structures on the vehicle body may be utilized, if appropriate.

With reference again to FIG. 1, so-called "pulling" is effected via a tower 90, a beam extension 100 and a hydraulic cylinder 110 attach to main beam 20 for applying a repairing force to a vehicle. The hydraulic cylinder is connected via a hydraulic hose 112 to a foot-operated, conventional hydraulic pump 114. The lower end of tower 90 is pivotally connected via pin 94 to one end of beam extension 100 so that tower 90 can be moved in the directions of curved double-headed arrow B, by expansion and contraction of hydraulic cylinder 110 diagonally disposed between tower 90 and beam extension 100 in the directions of double headed arrow C. A plurality of fingers 92 extend outward from tower 90 so that one end of a chain (not shown) can be attached or supported by one of fingers 92 and the other end of the chain can be attached to the vehicle. In addition, beam extension 100 is attachable to main beam 20 and is rotatable relative thereto about a longitudinal axis of main beam 20 as illustrated by double headed arrow D. Beam extension 100 is pivotally connected to main beam 20 so as to be pivotable about a vertically extending axis in the directions of double headed arrow E. Specifically, a pair of upper and lower generally circular plates 120 having a plurality of through holes 122 arranged along a curve and spaced from one another is attached to beam extension 100 at the end opposite tower 90. Main beam 20 is pivotally attached thereto via pins 124 and holes 122 to lock beam extension 100 in a fixed angle thereto.

At this time, the vehicle is ready for a "pull". The pump 114 is activated to operate the hydraulic cylinder which, in turn, pivots tower 90 which applies a repairing or pulling force to the vehicle via chains (not shown) as will be readily understood by those skilled in the art.

From the present description, it will be further appreciated that the vehicle repairing devices disclosed herein are significantly more compact and more particularly suitable for repairs on unibody vehicles than the prior art. Furthermore, the vehicle repair devices of the present invention can be attached to a vehicle more quickly and easily than the more cumbersome devices of the prior art. For example, the vehicle repairing devices of the present invention can be attached to a vehicle by jacking up one wheel thereof, removing the wheel, and sliding a main beam under the vehicle. The clamps can then be adjusted and connected to the pinch-welds and jack tabs of the unibody. Once the main beam and side arm are connected to the vehicle, a repairing force can be subsequently applied. It is also possible that the clamp or clamping adapter 60 and/or their subassemblies, such as the support bracket 72, could be used with conventional pulling equipment in which case four of such brackets would be used rather than only three as needed in connection with the vehicle repairing device of the present invention.

What is claimed is:

1. A dual clamping adapter for securing a vehicle body undercarriage having both horizontal pinch welds and vertical jack tabs to a vehicle repairing device comprising:

a generally L-shaped clamp bracket having a generally upright upper leg and a generally horizontal lower leg;

first means for releasably clamping a horizontal pinch-weld of a vehicle body undercarriage;

second means for releasably clamping a vertical jack tab of a vehicle body undercarriage;

means for adjustably mounting said first means for releasably clamping on said upper leg of said clamp bracket and said second means for releasably clamping on said lower leg of said clamp bracket; and means for releasably attaching said L-shaped clamp bracket to said means for adjusting the height of said clamp bracket.

2. The dual clamping adapter according to claim 1, wherein said first and second means for releasably clamping comprises a pair of clamping plates.

3. The dual clamping adapter according to claim 1, wherein said means for adjustably mounting comprises at least one elongated slot formed in said upper leg and at least one elongated slot formed in said lower leg.

4. The dual clamping adapter according to claim 3, wherein said lower leg has a pair of arms, each of which has at least one elongated slot formed therein.

5. The dual clamping adapter according to claim 1, additionally including means for adjusting the height of said clamp bracket.

6. The dual clamping adapter according to claim 5, wherein said means for adjusting the height of said clamp comprises a generally vertically-disposed threaded rod having a top end releasably secured to said lower leg of clamp bracket.

7. The dual clamping adapter according to claim 6, wherein said rod is supported in a cylindrical tube for vertically displaceably movement and said means for adjusting the height includes means for locking said rod at a fixed height relative to said tube.

8. The dual clamping adapter according to claim 1, wherein said lower leg is Y-shaped.

9. The dual clamping adapter according to claim 1, wherein said horizontal lower leg has a downwardly depending leg which defines said means for releasably attaching said L-shaped clamp bracket.

10. A device for straightening damaged vehicle bodies with an undercarriage having both horizontal pinch welds and vertical jack tabs comprising:

a first elongated member which is selectively positionable under the undercarriage of a damaged vehicle body, said first elongated member comprising a first end and a second end;

a second elongated member selectively attachable to said first elongated member at an angle of less than 90 degrees;

means for applying a pulling force selectively connectable to at least one of said elongated members and means for attaching said force applying means to a damaged vehicle; and two clamps slidably mounted on said first elongated member for attaching said first elongated member to said damaged body, and a clamp slidably mounted on said second elongated member for attaching said second elongated member to said damaged body, said clamps each comprising a generally L-shaped clamp bracket having a generally upright upper leg and a generally horizontal lower leg, first means for releasably clamping a horizontal pinchweld of a vehicle body undercarriage, second means for releasing clamping a vertical jack tab of a vehicle body undercarriage, means for adjustably mounting said first means for releasably clamping on said upper leg of said clamp bracket and said second means for releasably clamping on said lower leg of said clamp bracket, means for adjusting the height of said clamp bracket, and means for releasably attaching said L-shaped clamp bracket to said means for adjusting the height of said clamp bracket.

11. The device according to claim 10, wherein said first and second means for releasable clamping comprises a pair of clamping plates.

12. The device according to claim 10, wherein said means of adjustably mounting comprises at least one elongated slot formed in said upper leg and at least one elongated slot formed in said lower leg.

13. The device according to claim 12, wherein said lower leg has a pair of arms, each of which has at least one elongated slot formed therein.

14. The device according to claim 11, wherein said lower leg is Y-shaped.

15. The device according to claim 10, wherein said means for adjusting the height of said clamp comprises a generally vertically-disposed threaded rod and said means for releasably attaching said L-shaped clamp bracket comprises said rod having a top end releasably secured to said lower leg of said clamp bracket.

16. The device according to claim 15, wherein said rod is supported in a cylindrical tube for vertically displaceably movement and said means for adjusting the height includes means for locking said rod at a fixed height relative to said tube.

17. The device according to claim 15, wherein said horizontal lower leg has a downwardly depending leg and said rod has means for releasably clamping said downward depending leg which cooperatively define said means for releasably attaching said L-shaped clamp bracket to said means for adjusting the height of said bracket.

* * * * *